US012025420B2

(12) United States Patent
Schlenter et al.

(10) Patent No.: US 12,025,420 B2
(45) Date of Patent: Jul. 2, 2024

(54) BLASTING SYSTEM

(71) Applicant: DETNET SOUTH AFRICA (PTY) LTD, Johannesburg (ZA)

(72) Inventors: Craig Schlenter, Johannesburg (ZA); Marinus Yates, Benoni (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 90 days.

(21) Appl. No.: 17/924,815

(22) PCT Filed: May 7, 2021

(86) PCT No.: PCT/ZA2021/050030
§ 371 (c)(1),
(2) Date: Nov. 11, 2022

(87) PCT Pub. No.: WO2021/232074
PCT Pub. Date: Nov. 18, 2021

(65) Prior Publication Data

US 2023/0235999 A1 Jul. 27, 2023

(30) Foreign Application Priority Data

May 15, 2020 (NA) ..... NA/P/2020/0014

(51) Int. Cl.
*F42D 1/02* (2006.01)
*F42D 1/055* (2006.01)

(52) U.S. Cl.
CPC ..... *F42D 1/02* (2013.01); *F42D 1/055* (2013.01)

(58) Field of Classification Search
CPC ..... F42D 1/02; F42D 1/055
USPC ..... 102/206
See application file for complete search history.

(56) References Cited

U.S. PATENT DOCUMENTS 6,941,870 B2 * 9/2005 McClure ..... F42D 1/055 102/311
2004/0225431 A1 * 11/2004 Aebi ..... F42D 1/055 701/115
2005/0103219 A1 * 5/2005 McClure ..... F42D 1/055 102/311
2010/0116165 A1 * 5/2010 Moore ..... F42D 3/04 102/311
2011/0083574 A1 * 4/2011 LeVan ..... F42D 1/055 102/215

(Continued)

FOREIGN PATENT DOCUMENTS

WO 0231431 A1 4/2002
WO 2015168709 A2 11/2015

OTHER PUBLICATIONS

International Search Report for PCT/ZA2021/050030, international filing date of May 7, 2021, date of mailing Aug. 25, 2021, 3 pages.

(Continued)

*Primary Examiner* — Samir Abdosh
(74) *Attorney, Agent, or Firm* — CANTOR COLBURN LLP

(57) ABSTRACT

A blasting system which includes a number of roving GPS receivers, and associated taggers, which communicate with one another and with a control mechanism, and a reference GPS receiver which transmits RTCM corrective positional data which is stored at each roving GPS receiver to improve the accuracy of coordinate determinations for boreholes.

10 Claims, 1 Drawing Sheet

(56) References Cited

U.S. PATENT DOCUMENTS

| | | | | |
|---|---|---|---|---|
| 2015/0241191 | A1* | 8/2015 | Garcia | F42D 3/04 102/311 |
| 2016/0195379 | A1* | 7/2016 | Van Wyk | F42D 1/05 102/200 |
| 2017/0030695 | A1* | 2/2017 | Kruger | F42D 5/00 |
| 2018/0299240 | A1* | 10/2018 | Van Wyk | F42D 1/055 |
| 2021/0080241 | A1* | 3/2021 | Park | F42D 1/055 |
| 2021/0231426 | A1* | 7/2021 | Kuk | F42D 5/00 |
| 2021/0333077 | A1* | 10/2021 | Kuk | H04W 56/00 |
| 2021/0333078 | A1* | 10/2021 | Hwang | G08C 17/02 |

OTHER PUBLICATIONS

Written Opinion for PCT/ZA2021/050030, international filing date of May 7, 2021, date of mailing Aug. 25, 2021, 5 pages.

* cited by examiner

BLASTING SYSTEM

CROSS-REFERENCE TO RELATED APPLICATIONS

This application is a U.S. national stage application of International Application No. PCT/ZA2021/050030 entitled "BLASTING SYSTEM", which has an international filing date of 7 May 2021, and which claims priority to Namibian Patent Application No. NA/P/2020/0014, filed 15 May 2020.

BACKGROUND OF THE INVENTION

This invention relates to a blasting system.

The effectiveness of a blasting system, particularly a system which makes use of electronic detonators, is dependent on the accuracy of data relating to the geographical positions of boreholes in which detonators are positioned, the nature of the rock or burden in which the boreholes are formed, and the timing delay assigned to each respective detonator.

U.S. Pat. No. 6,941,870 relates to a positional blasting system wherein blasting information is automatically determined by a positional detecting device such as a GPS as a function of the distance and direction of movement of the device to a particular detonator. This approach is adopted to address a variety of problems described in the preamble to the specification.

A typical GPS has an accuracy of about 10 meters. This factor inherently limits the extent to which a respective time delay which is to be assigned to each detonator to achieve an optimum blast pattern, can be precisely calculated. Another aspect is that at a blast site which has a large number of boreholes or where the boreholes are fairly closely positioned to one another the accuracy of the GPS might not be sufficient to allow one borehole to be distinguished in a geographical sense from another borehole.

An allied factor is that signals to a GPS receiver, at a blast site, can come directly from a satellite or can be reflected by structures near the blast site to the GPS receiver. The latter possibility creates uncertainty as to the accuracy of the positional data.

U.S. Pat. No. 6,941,870 appears to be based on the premise that the blast site is planar. However, at a large blast site which extends over a substantial area the effect of the curvature of the earth should be taken into account. This means that the surface in which the boreholes are drilled should not be treated as a planar or two-dimensional surface.

An object of the present invention is to address the aforementioned issues and to provide a blasting system in which the positions of boreholes can be determined with an improved degree of accuracy.

SUMMARY OF THE INVENTION

The invention provides a blasting system which is established at a blast site, the blasting system including a control mechanism, a plurality of boreholes at the blast site, a base antenna positioned at a known reference location at the blast site, a reference GPS receiver, which includes a transmitter, in communication with the base antenna, and at least one roving GPS receiver, which is movable by an operator on the blast site, which receives positional data corrections from the transmitter at the reference GPS receiver and which is in communication with the control mechanism.

Preferably the corrections are RTCM corrections i.e. those which comply with the format recommendations of the Radio Technical Commission for Maritime Services. This reference is nonetheless exemplary, and is non-limiting. Each correction can include data from various sources but, more particularly, specifies a correction which is used to generate more accurate latitude and longitude measurements by the roving GPS receiver.

The correction at the roving GPS receiver can be done by means of a post-processing exercise but, preferably, is done in real time. For example in respect of a roving GPS receiver that collects real time data, a line of sight from the GPS receiver to a satellite can be blocked, or a satellite can be so low on the horizon that it provides only a weak signal. Reprocessing the real time data using RTCM corrections from the reference GPS receiver allows the real time data to be made more reliable and accurate. Feedback data of this kind is dependent on the quality of the GPS signals—an aspect which is particularly important when the strength of the GPS signal is restricted due to limited sky visibility.

The base antenna is preferably located directly over a borehole selected from the said plurality of boreholes. This approach has the benefit that offsets or errors related to recording the borehole positions are mitigated as relative accuracy is maintained.

A GPS antenna requires a ground plane with a minimum diameter on which the antenna sits in order to reduce the incidence of multipath signals to the antenna. Due to space constraints which may prevail at a blast site the invention provides that an effectively larger ground plane can be simulated by making use of a conductor which acts as a ground plane of relatively small dimensions from which a collar extends upwardly to surround at least a part of the antenna.

In one embodiment of the invention the blasting system includes a tagger with a GPS receiver in which the coordinates for each borehole are stored. Typically these coordinates would be generated automatically during the use of autonomous or automated techniques implemented to drill boreholes at a blast site. When these techniques are adopted the coordinates are known to an acceptable degree of accuracy. The use of the differential GPS approach, as described, enables positional data which has been stored at the control mechanism to be used as the reference location from which the corrections will be generated.

A blast design package is used to calculate the timing for each detonator within a borehole. A blast plan can be downloaded to a tagger associated with the roving GPS receiver. This tagger may then automatically transfer data relating to the position of the base antenna to the control mechanism either from a borehole coordinate from within the blast plan or through user input.

The control mechanism attempts to validate the position configured by the base antenna to ensure that such configured location is within the appropriate bounds of the current base antenna GPS reading. Once the base antenna position has been configured on the control mechanism the corrections are generated and broadcast to the roving taggers.

On a blast site with a large number of boreholes, of the order of several thousand, it is not unusual for confusion to exist regarding the position of a tagger in relation to a particular borehole. In order to ensure that the tagger is functioning in respect of a correctly identified borehole a processor, possibly in the tagger, is employed to implement a high precision distance calculation to determine the borehole which is closest to the tagger once the GPS accuracy of the roving tagger is within acceptable limits.

The tagger then identifies if the current detonator or detonators within a borehole have been programmed with delays (i.e. tagged) and first presents those which have not been programmed. The user would be able to programme the detonators automatically by presenting the detonator or detonators to the tagger.

The roving tagger is able to programme the correct delays for a plurality of detonators within a borehole based on a length identifier stored within each respective detonator. Such programming can be effected automatically.

Use may be made of a plurality of said roving GPS receivers which are interactive with one another and with the control mechanism so that the data which is held in any tagger is identical to the data held in each other tagger, and in the control mechanism.

The use of one or more roving GPS receivers means that data relating to the modification of a borehole position, or to the addition of a borehole, is captured as an operator traverses the blast site. The data is transmitted to other roving taggers and to the control mechanism. The control mechanism thus is in a position automatically to verify or to recalculate, as may be appropriate, timing delays on an optimal basis for all detonators which are placed or which are to be placed in the various boreholes.

It is possible, depending on a variety of factors, that accurate positional co-ordinates are not available for each borehole. This may be due to a mine not having access to automated drilling techniques. However knowledge of the exact locations for the as-drilled boreholes allows the mine to determine the optimum timing to achieve the highest yield possible for a given situation. In this case each of the roving GPS receivers, which determine positional data for each borehole, is used to store the positional data which creates a blast plan from the actual, as-drilled, positions. The tagger is thus used as a location logger in that an operator using the tagger at each borehole captures data which accurately specifies the position of the borehole and that data is then transferred directly to blast design software, e.g. at the control mechanism, which would be used to calculate the timing information.

When blast objectives such as the aggregate size, the blast vector, the position of each blast hole, the number of detonators and their depths etc. are known, then the control mechanism can calculate the detonator timings as they are added to the blast design via the location logger i.e. the tagger which is used as such.

In this instance the control mechanism calculates the ideal timing for each detonator, based on the blast objective, on an adhoc basis until there are no more boreholes/detonators to be added to the blast plan. The time delay data for the detonators can be stored in the control mechanism for subsequent transmission to the respective detonators. However, it falls within the scope of the invention for the time delay for each denotator to be transferred to the denotator in real time i.e. once the detonator's position has been accurately determined and, dependent thereon, the time delay for the denotator has been calculated.

The timing delay for each detonator is stored in each of the roving GPS receivers. Thus each GPS receiver has stored timing data which is identical to the stored timing data in each of the other GPS receivers. Thus any of the roving GPS receivers can be used to program the correct timing delay into each detonator. This can be done at any appropriate time.

Alternatively if the location logging occurs once detonators have been deployed into the boreholes then the location logger can uniquely identify each detonator when logging the location of each borehole. Once all the positional data of the borehole locations has been recorded the control mechanism using custom designed software can calculate the ideal timing delay for each detonator. The control mechanism can then communicate the calculated timing delays directly to the respective detonators.

In another embodiment of the invention it is possible that accurate co-ordinates are available but they are not able to be transformed into a format compatible with the GPS receiver either at the control mechanism or at any of the roving GPS receivers. Similarly an operator may not be able to place a base antenna over a borehole and might not have a reference which specifies the location at which the base antenna is to be placed. The roving tagger may then be adapted to prompt the operator to record the positions of a selected number of boreholes. The positions of the remaining boreholes may then be extrapolated, and GPS positions may be assigned to these boreholes.

BRIEF DESCRIPTION OF THE DRAWINGS

The invention is further described by way of example with reference to the accompanying drawings in which.

DESCRIPTION OF PREFERRED EMBODIMENT

Figure 1:
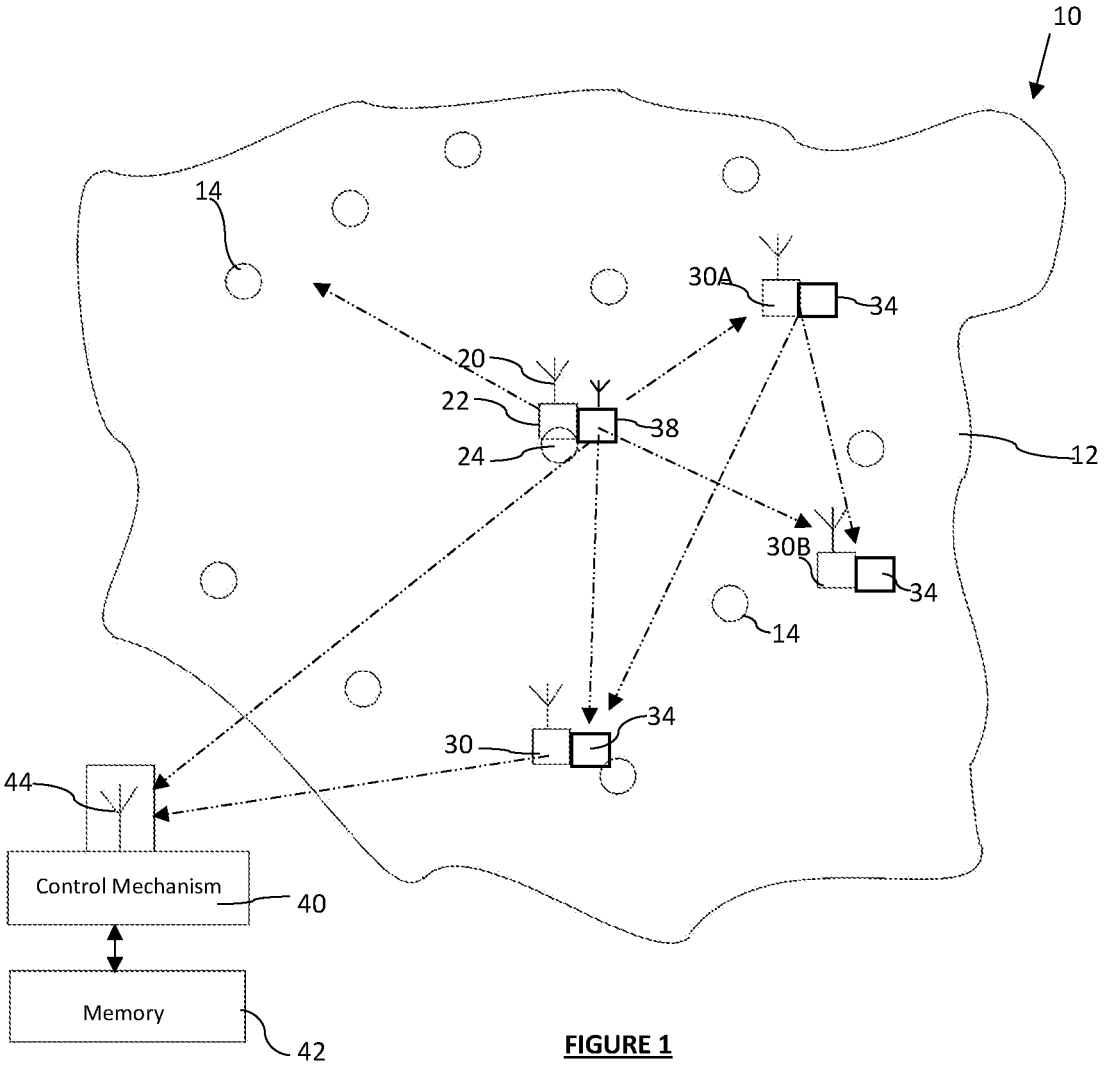
FIG. 1 schematically depicts a blasting system established at a blast site in accordance with the principles of the invention.

FIG. 1 of the accompanying drawings schematically depicts a blasting system 10 according to the invention which is established at a blast site 12.

The blast site 12 typically extends over a large area and includes a large number of boreholes 14, possibly of the order of several thousand. As is known in the art each borehole 14 is loaded with explosive material and one or more detonators (not shown).

If the boreholes 14 are drilled by means of automated or autonomous drilling machines then the geographical position of each borehole, in terms of longitude and latitude coordinates, is automatically determined and is known with an acceptable degree of accuracy. Despite this it can be difficult for an operator using a tagger to establish where, on the blast site, the operator is i.e. to identify a borehole in the midst of a large number of boreholes, which may be closely spaced from one another.

In some instances automated drill rigs are not used. As a consequence a plan which accurately reflects the positions of the boreholes is not available.

If the blast site 12 extends over a large area then the curvature of the earth must be taken into account so that the position of each borehole can be accurately determined i.e. it is not acceptable to view the blast site as a planar or two-dimensional site.

In each instance in order to obtain accurate data relating to the position of each borehole 14 a differential GPS system is employed. Use is made of a base or reference antenna 20 which is positioned at a known location 22 on the blast site. Preferably the known location 22 is a borehole 24 selected from the plurality of boreholes 14. This however is not essential for a reference location 22 can be selected using other criteria. The use of a selected borehole 24 has the benefit that any offset or error arising in recording the position of the borehole 24 is mitigated as the positions of the remaining boreholes are determined using a reference system based on the positional data of the chosen borehole 24.

A number of roving GPS receivers 30, 30A, 30B etc. can be used at the blast site. Each roving GPS receiver is associated with a respective tagger 34 and is carried by a respective operator, not shown, who traverses the blast site 12. The taggers 34 can communicate with each other using transceivers and can also communicate with a reference GPS receiver 38 which is associated with the base antenna 20 and which is at the reference location 22. The reference GPS receiver 38 includes a transmitter 38(T) for the transmission of data.

The blasting system 10 also includes a control mechanism 40, positioned at any appropriate location, which includes a memory unit 42 and a communication facility 44.

If the boreholes 14 are drilled at precisely determined locations using, for example, automated drill rigs then the geographical coordinates (longitude and latitude) of each borehole are known with an acceptable degree of accuracy. That data is collected at the time of borehole drilling and when appropriate is stored in the memory unit 42.

A GPS receiver typically works with an accuracy of, say, ten meters. Apart therefrom, as noted hereinbefore, signals to the GPS receiver can be adversely affected by various physical factors. To address these aspects the invention makes use of a differential GPS approach in that the reference GPS receiver 38 is in communication with the base antenna 20 which is at the reference location 22. The coordinates of the reference location 22 are known and are stored in the memory unit 42.

As a roving GPS receiver 30, plus an associated tagger 34, traverses the blast site 12 the respective operator positions the GPS receiver 30 directly over a selected borehole and determines the GPS coordinates thereof. RTCM data from the reference GPS receiver 38 is transmitted continuously, or as required, to each roving GPS receiver and the correction factors transmitted in this way are applied in real time to correct the data in the GPS receiver 30 so that the coordinates e.g. the longitude and latitude positions of the borehole in question are determined with an acceptable degree of accuracy. Such determination (i.e. of the coordinates) is transmitted from the GPS receiver in question to the other roving GPS receivers and to the control mechanism 40. Thus, at all times, each GPS receiver and associated tagger carry the same information as the other roving GPS receivers and associated taggers, and that information is replicated at the control mechanism 40. At the control mechanism a processor, using known techniques, calculates the timing delays associated with the respective detonators which are to be placed in the respective boreholes 24. This makes it possible for the time delays to be calculated in real time as each borehole is processed in the aforementioned way i.e "added" to the systems. The time delays can thus immediately be assigned to the various denotators.

It is possible for a tagging plan generated at the control mechanism 40 to be downloaded to each roving GPS receiver and associated tagger. The tagger then determines the boreholes which are closest and the operator then assigns the calculated timing of delays to the respective detonators.

If accurate data relating to the positions of the boreholes is not available from the memory unit 42, for example if automated drill rigs were not used in the drilling of the boreholes 14, then each tagger may have the capability to create a location-accurate plan of the blast site. This is achieved when the operator walks to each borehole 14 and adds positional data of the borehole, corrected using RTCM factors from the reference GPS receiver 38, to the geographical plan. As indicated this data is transferred to all other taggers in the system and to the control mechanism 40.

Once all the boreholes have been tagged in the described manner the control mechanism calculates the timing delays for the respective detonators which are to be placed in the boreholes and this timing data is transmitted to each of the taggers. The detonators can then be programmed as appropriate and placed in the boreholes in order to implement the blasting system. As indicated though the time delay for each denotator can be calculated in real time, as each borehole is tagged, and then assigned to the detonator. This detonator would be programmed with accurately determined timing delays during the tagging sequence.

Figure 2:
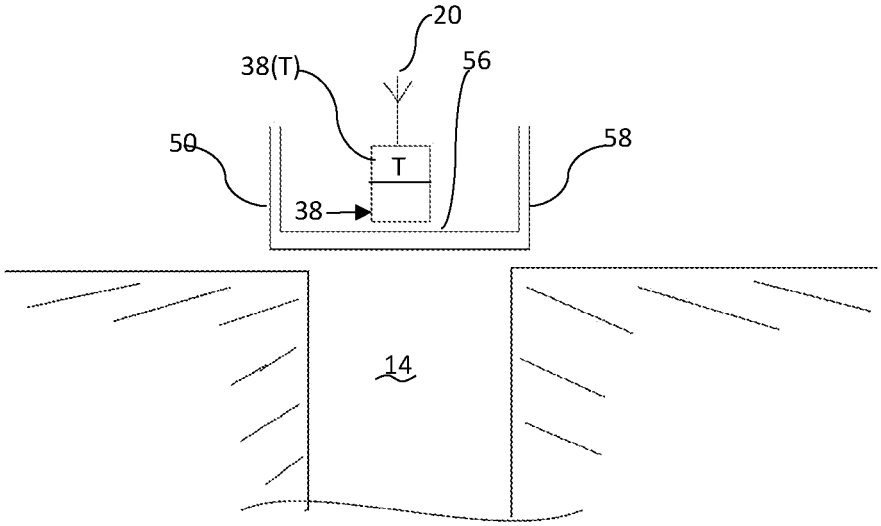
FIG. 2 depicts a base antenna used in the blasting system.

The antenna configuration shown in FIG. 2 reduces the ground area required to have an effective ground plane. The antenna 20 is primarily used when there is a space constraint e.g. during use of a mobile device. This cautionary step is taken to reduce the incidence of multipath propagations of signals. Use is made of a conductive structure 50 with a base plate 56 which preferably is placed directly over the selected borehole 24. The plate 56 is surrounded by a vertically extending collar 58 which partly surrounds the antenna 20. This arrangement has been found to be effective in simulating a larger ground plane and in eliminating the incidence of reflected signals onto the antenna.

The invention claimed is:

1. A blasting system which is established at a blast site, the blasting system including a control mechanism, a plurality of boreholes at the blast site, a base antenna positioned at a known reference location at the blast site, a reference GPS receiver-, which includes a transmitter, in communication with the base antenna, and at least one roving GPS receiver, which is movable by an operator on the blast site, which receives positional data corrections from the transmitter at the reference GPS receiver and which is in communication with the control mechanism.

2. A blasting system according to claim 1 wherein the positional data corrections are RTCM corrections.

3. A blasting system according to claim 1 wherein the base antenna is positioned on a conductive base plate which is placed directly over the reference location and which is surrounded by a conductive collar.

4. A blasting system according to claim 1 which includes a respective tagger which is associated with each roving GPS receiver and wherein the corrected positional data for all of the boreholes is stored at each roving GPS receiver and at the control mechanism.

5. A blasting system according to claim 4 wherein the control mechanism is configured, in response to positional data corrections for each borehole, to calculate a timing delay for a detonator in such borehole.

6. A blasting system according to claim 5 wherein the respective tagger is configured to receive said timing delay from the control mechanism and to assign the timing delay to the denotator.

7. A blasting system according to claim 1 which includes a plurality of said roving GPS receivers and a plurality of taggers which are respectively associated with the roving GPS receivers, and wherein the roving GPS receivers are interactive with one another and with the control mechanism so that the data which is held in any tagger is identical to the data held in each other tagger, and in the control mechanism.

8. A blasting system according to claim 1 which includes a plurality of said roving GPS receivers and, a plurality of taggers, each tagger being associated with a roving GPS receiver and wherein said transmitter transmits to all the GPS receivers corrective positional data so that accurate positional data for each borehole is determined by the respective GPS receiver and wherein the positional data for all of the boreholes is stored in all of the taggers and in the control mechanism.

9. A blasting system according to claim 8 wherein the control mechanism is configured, in response to the said corrective positional data for a borehole, to calculate a timing delay for a detonator in such borehole.

10. A blasting system according to claim 9 wherein the respective tagger is configured to receive said timing delay from the control mechanism and to assign the timing delay to the detonator.

* * * * *